US012691351B2

(12) United States Patent
Mason et al.

(10) Patent No.: US 12,691,351 B2
(45) Date of Patent: Jul. 28, 2026

(54) SLOPE ESTIMATOR TRAINING APPARATUS AND RELATED METHOD

(71) Applicant: WhyGolf LLC, Escondido, CA (US)

(72) Inventors: Bradley R. Mason, Escondido, CA (US); Jeffrey T. Mason, Escondido, CA (US)

(73) Assignee: WhyGolf LLC, Escondido, CA (US)

( * ) Notice: Subject to any disclaimer, the term of this patent is extended or adjusted under 35 U.S.C. 154(b) by 153 days.

(21) Appl. No.: 18/432,953

(22) Filed: Feb. 5, 2024

(65) Prior Publication Data

US 2025/0249336 A1 Aug. 7, 2025

(51) Int. Cl.
*A63B 69/36* (2006.01)

(52) U.S. Cl.
CPC ..... *A63B 69/3676* (2013.01); *A63B 2220/18* (2013.01)

(58) Field of Classification Search
CPC ..... A63B 69/3676; A63B 2220/18
See application file for complete search history.

(56) References Cited

U.S. PATENT DOCUMENTS 4,372,555 A * 2/1983 Sorensen ..... A63B 63/083 473/481
4,911,440 A * 3/1990 Hyman ..... A63B 22/16 482/146
8,734,308 B1 * 5/2014 Joslin ..... A63B 22/18 482/79
2004/0121888 A1 * 6/2004 Williams ..... A63B 21/028 482/121
2009/0151605 A1 * 6/2009 Buhler ..... A47B 13/023 108/4
2009/0313839 A1 * 12/2009 Spaulding ..... G01C 9/28 33/379
2022/0176192 A1 * 6/2022 Santos ..... A63B 24/0062
2023/0020053 A1 * 1/2023 Chapman ..... A63D 3/00

* cited by examiner

*Primary Examiner* — Joseph B Baldori
*Assistant Examiner* — Christopher Glenn
(74) *Attorney, Agent, or Firm* — CP LAW GROUP PC; Cy Bates

(57) ABSTRACT

A slope estimator training apparatus has an apparatus body with a top surface having one or more sloped surfaces. A center segment extends across an apparatus periphery of the apparatus body and partitions the apparatus body into a first section and a second section. Each of the first and second section have a sloped surface. The slope estimator training apparatus further includes slope markings disposed on the top surface at each of the first section and the second section. The slope markings include a range of values having both a descending sequence and an ascending sequence. The descending sequence is disposed on the first section and the ascending sequence disposed on the second section. The slope estimator training apparatus allows a player to train their skill in estimating steepness of a slope with a feel of their feet instead of or in addition to making a visual assessment.

20 Claims, 8 Drawing Sheets

SLOPE ESTIMATOR TRAINING APPARATUS AND RELATED METHOD

BACKGROUND

Field of the Invention

This invention relates to training apparatus; more particularly, a slope estimator training apparatus comprising a sloped surface.

Description of the Related Art

Putting in golf is a challenging skill due to the precision required to sink a relatively small ball into a distant hole. One critical factor that significantly contributes to the difficulty is the assessment of the steepness of a hill or the slope of the putting green. The steepness of the terrain plays a pivotal role in determining the speed and direction of the putt. Golfers must gauge the slope's severity to adjust their stroke accordingly, as even a subtle incline can cause the ball to deviate from its intended path. Players often misread putts because the are using their eyes to assess steepness. There is a need for an apparatus and related method to train players how to better estimate slope on the putting green.

SUMMARY

A slope estimator training apparatus is disclosed. The slope estimator training apparatus comprises an apparatus body having a top surface and bottom surface opposite the top surface, the top surface comprising one or more sloped surfaces. A center segment extends across an apparatus periphery of the apparatus body and partitions the apparatus body into a first section and a second section. Each of the first and second section comprise a sloped surface. The slope estimator training apparatus further comprises slope markings disposed on the top surface at each of the first section and the second section. The slope markings comprise a range of values having both a descending sequence and an ascending sequence. The descending sequence is disposed on the first section and the ascending sequence disposed on the second section.

The first section and the second section may be integrally formed or detachably coupled. The slope estimator training apparatus may further comprise a level indicator disposed at the center segment. In some embodiments, the sloped surface of the first section and the sloped surface of the second section form a concave surface.

The slope estimator training apparatus allows a player to train their skill in estimating steepness of a slope with a feel of their feet instead of or in addition to making a visual assessment.

BRIEF DESCRIPTION OF THE DRAWINGS

Other features, combinations, and embodiments will be appreciated by one having the ordinary level of skill in the art upon a thorough review of the following details and descriptions, particularly when reviewed in conjunction with the drawings, wherein.

DETAILED DESCRIPTION

Figure 1:
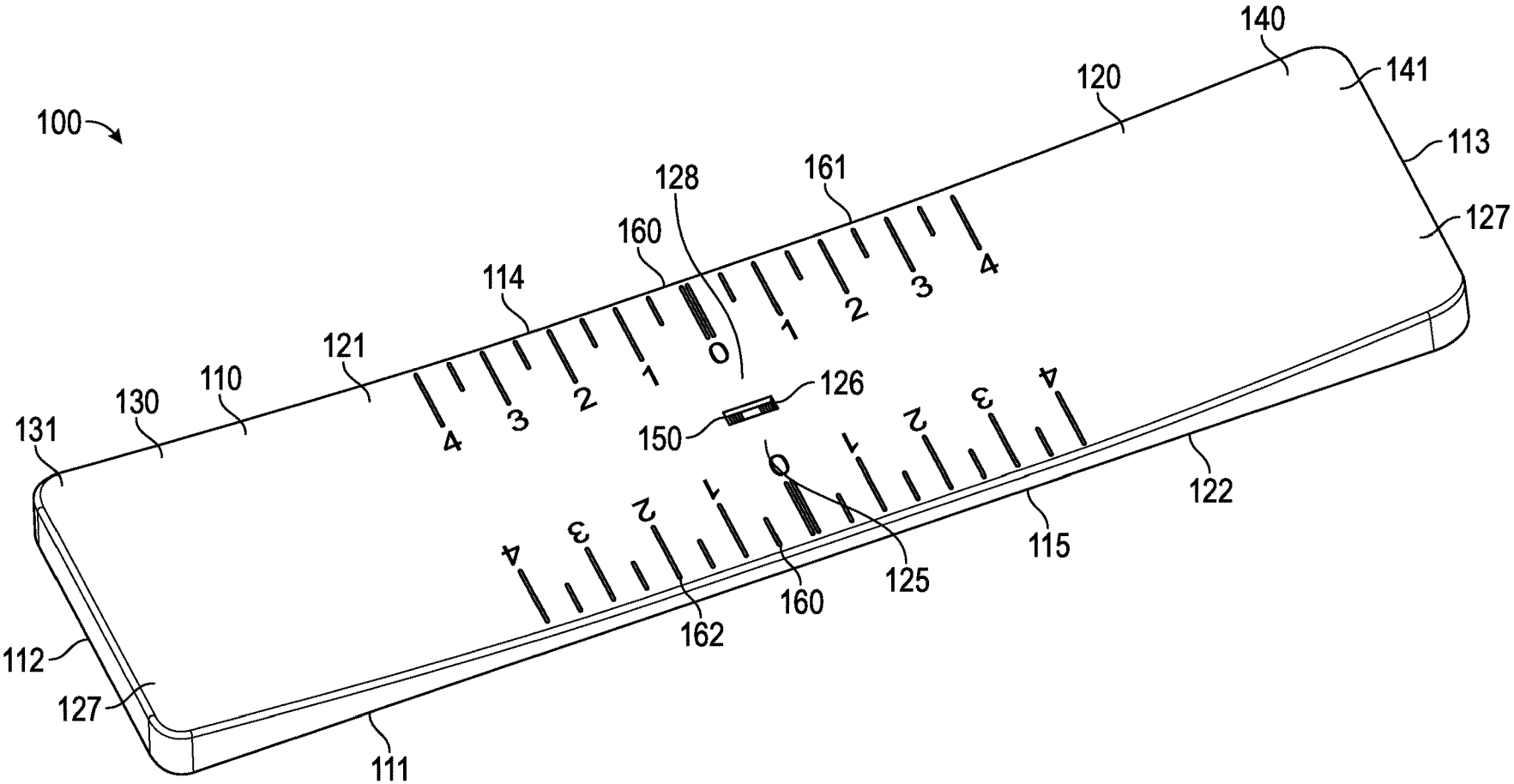
FIG. 1 shows a perspective view of a slope estimator training apparatus in accordance with a first illustrated embodiment.
Figure 2:
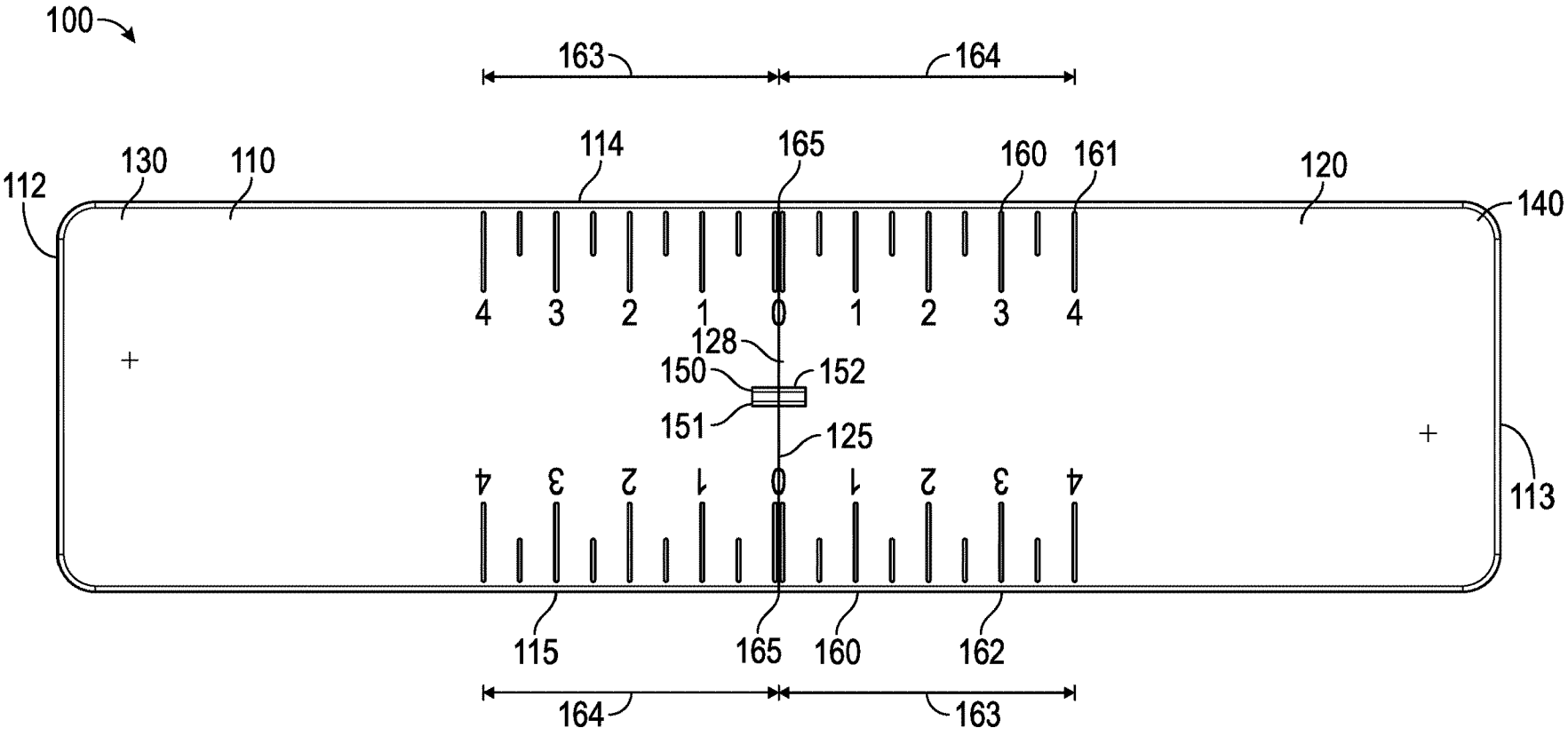
FIG. 2 shows a top view of the slope estimator training apparatus according to the first illustrated embodiment.
Figure 3A:
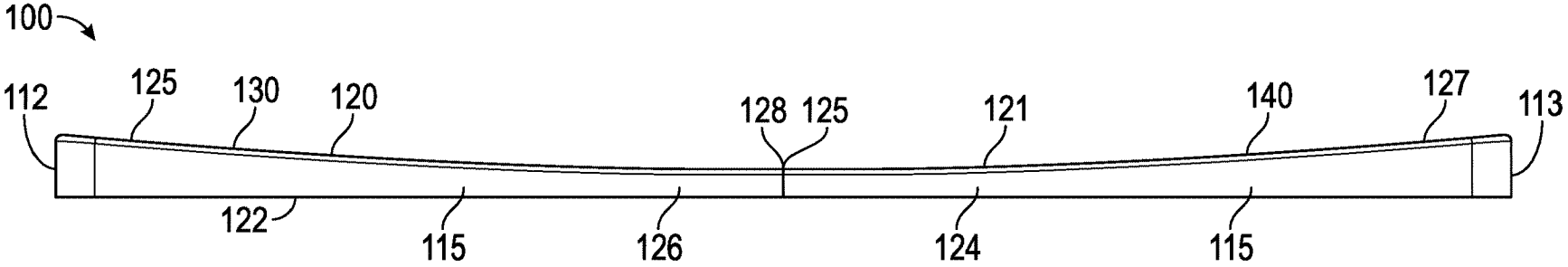
FIG. 3A shows a side view of the slope estimator training apparatus according to the first illustrated embodiment.
Figure 3B:
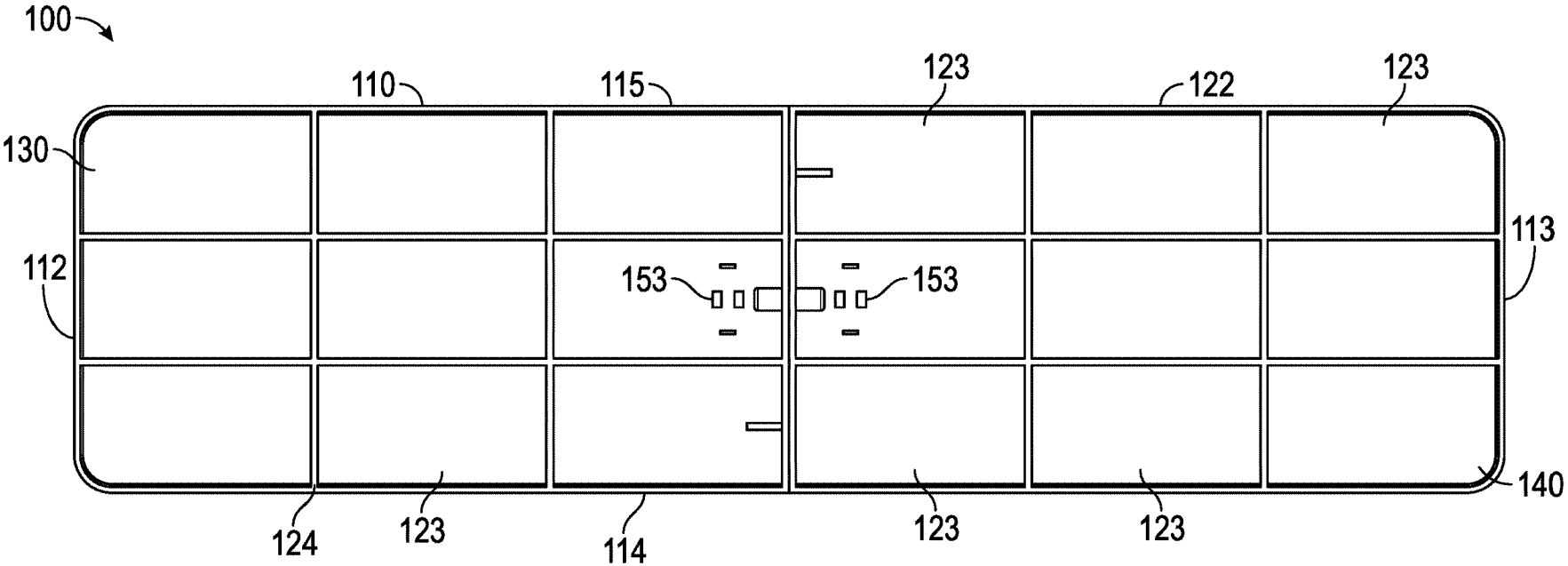
FIG. 3B shows a bottom view of the slope estimator training apparatus according to the first illustrated embodiment.

For purposes of explanation and not limitation, details and descriptions of certain preferred embodiments are hereinafter provided such that one having ordinary skill in the art may be enabled to make and use the invention. These details and descriptions are representative only of certain preferred embodiments, however, a myriad of other embodiments which will not be expressly described will be readily understood by one having skill in the art upon a thorough review of the instant disclosure. Accordingly, any reviewer of the instant disclosure should interpret the scope of the invention only by the claims, as such scope is not intended to be limited by the embodiments described and illustrated herein.

For purposes herein, the term "concave" means a surface that curves inwards towards a center of the associated object.

The term "slope percentage" means a measurement of steepness of a slope or incline.

The term "bottom surface" means the bottommost or lowermost portion of an apparatus. The bottom surface can be a homogenous surface comprising a solid bottom surface. The bottom surface can be a heterogenous surface comprising pockets such as a lattice structure.

The term "trough" means lowest point or depression within a concave shape.

The term "flange" means a projected flat rim or collar used to join two components.

The term "level indicator" means a device or instrument used to determine whether a surface is level and has no incline or tilt. Examples can include, but are not limited to bubble levels, spirit levels, digital levels, and the light. Level indicator includes both mechanical and electrical devices.

The term "descending sequence" means a sequence of values, when read in their upright position from left to right, or in a clockwise fashion, the values of the sequence are decreasing.

The term "ascending sequence" means a sequence of values, when read in their upright position from left to right, or in a clockwise fashion, the values of the sequence are increasing.

The term "fully separate" means complete separation between to sections such that no portion of one section is coupled to the other.

Unless explicitly defined herein, terms are to be construed in accordance with the plain and ordinary meaning as would be appreciated by one having skill in the art.

General Description of Embodiments

In one embodiment, a slope estimator training apparatus is disclosed. The slope estimator training apparatus comprises an apparatus body having an apparatus periphery, the apparatus periphery comprising a first minor side, a second minor side opposite the first minor side, a first major side adjacent to each of the first and second minor sides, and a second major side opposite the first major side. The apparatus further comprises a top surface and a bottom surface opposite the top surface, the top surface comprising a concave surface. A center segment extends from the first major side to the second major side. The center segment partitions the apparatus body into a first section and a second section wherein the center segment comprises a trough of the concave surface. Additionally, slope markings are disposed on the top surface at each of the first section and the second section. The slope markings comprise a range of values having both a descending sequence and an ascending sequence, wherein the descending sequence is disposed on the first section and the ascending sequence is disposed on the second section.

In some embodiments, the bottom surface may comprise a level surface.

In some embodiments, the bottom surface may comprise a plurality of pockets. A level indicator holder may be disposed in one of the plurality of pockets.

In some embodiments, the apparatus may further comprise a level indicator is disposed at the center segment and coupled to each of the first section and the second section. The level indicator may be positioned between the top surface and the bottom surface. The apparatus may further comprise a viewing port is disposed between the level indicator and the top surface, where the viewing port configured to make the level indicator externally viewable. In some embodiments, the level indicator may further comprise a tubular form wherein the tubular form is perpendicular to the center segment.

In some embodiments, the first section may further comprise a first channel extending from the center segment towards the first minor side, the first channel configured to surround at least a portion of the level indicator. The second section may further comprise a second channel extending from the center segment towards the second minor side, the second channel configured to surround at least a portion of the level indicator.

Generally, the slope markings may represent a percentage slope.

In some embodiments, the slope markings may further comprise a first set of slope markings and a second set of slope markings. In some embodiments, the second set may be in a mirror configuration with the first set. In some embodiments, the first set and the second set may each comprise the descending sequence and the ascending sequence. In some embodiments, the first set may be adjacent to the first major side and the second set may be adjacent to the second major side.

In some embodiments, the ascending sequence may be in a mirror configuration with the descending sequence.

In some embodiments, the range of values may comprise a value of zero, the value of zero being disposed at the center segment. In some embodiments, the ascending sequence and the descending sequence share the value of zero.

In some embodiments, the first section and the second section may be inseparable and integrally formed.

In some embodiments, the first section and the second section may be detachably coupled. The first section may comprise a first half of the apparatus body and the second section comprises a second half of the apparatus body. The first half may be identical to the second half.

In some embodiments, the first section may further comprise a first narrowed side opposite the first minor side, and the second section may further comprise a second narrowed side opposite the second minor side, wherein the first narrowed side and the second narrowed side form the center segment. The first narrowed side may further comprise a first inner surface, and the second narrowed side may further comprise a second inner surface. In some embodiments, the first inner surface may further comprise a first flange, and the second inner surface may further comprise a second flange, wherein the first flange is configured to engage with the second inner surface, and the second flange is configured to engage with the first inner surface.

In some embodiments, the first section may comprise a portion of the viewing port, and the second section comprises another portion of the viewing port.

In another embodiment, a slope estimator training apparatus is disclosed. The slope estimator training apparatus comprises an apparatus body having a top surface and bottom surface opposite the top surface. The top surface comprises one or more sloped surfaces, A center segment extends across an apparatus periphery of the apparatus body. The center segment partitions the apparatus body into a first section and a second section, each of the first and second section comprising the sloped surface. The apparatus further comprises slope markings disposed on the top surface at each of the first section and the second section. The slope markings comprise a range of values having both a descending sequence and an ascending sequence. The descending sequence is disposed on the first section and the ascending sequence is disposed on the second section.

In some embodiments, the bottom surface may comprise a level surface. The bottom surface may comprise a plurality of pockets.

Generally, the slope markings represent a measurement of slope. The measurement of slope may comprise a slope percentage.

In some embodiments, the slope markings may further comprise a first set of slope markings and a second set of slope markings. The second set may be in a mirror configuration with the first set. The first set and the second set may each comprise the descending sequence and the ascending sequence. The ascending sequence may be in a mirror configuration with the descending sequence.

In some embodiments, the range of values may comprise a value of zero wherein the ascending sequence and the descending sequence share the value of zero.

In one embodiment, a detachable section of a slope estimator training apparatus is disclosed. The detachable section comprises an apparatus body having an apparatus periphery comprising a broad side, a narrowed side opposite the broad side, a first major side, and a second major side opposite the first major side. The detachable section further comprises a top surface and a bottom surface opposite the top surface, the top surface comprising a sloped surface tapering downwards from the broad side toward the narrowed side. An inner surface is disposed at the narrowed side, the inner surface comprising a flange coupled thereto. Slope markings are disposed on the top surface, the slope markings comprising a range of values having at least one of a descending sequence or an ascending sequence.

In some embodiments, the channel is configured to receive a portion of a level indicator.

In some embodiments, the detachable section may further comprise a channel extending into the inner surface. A viewing port may be disposed between the channel and the top surface.

In some embodiments, the bottom surface may comprise a level surface. The bottom surface may comprise a plurality of pockets. A level indicator holder may be disposed in one of the plurality of pockets.

In some embodiments, the detachable section may further comprise a level indicator configured to detachably couple to the channel.

In some embodiments, the slope markings may comprise both the descending sequence and the ascending sequence. The descending sequence may be disposed at the first major side and the ascending sequence may be disposed at the second major side. The ascending sequence may be in a mirror configuration with the descending sequence.

Generally, the slope markings represent a measurement of slope. The measurement of slope may comprise a slope percentage.

In some embodiments, the slope markings may further comprise a first set of slope markings and a second set of slope markings. The second set may be in a mirror configuration with the first set. The first set may be adjacent to the first major side and the second set may be adjacent to the second major side.

In one aspect, a method of assembling a slope estimator training apparatus is disclosed. The slope estimator training apparatus comprises a first section and a second section, The method comprises: (i) inserting a level indicator into the first section at a first channel, the first channel disposed on a first inner surface of the first section; (ii) aligning a second channel of the second section with the first channel of the first section, the second channel disposed on a second inner surface of the second section; (iii) misaligning a top surface of the second section with a top surface of the first section; (iv) inserting a remaining portion of the level indicator into the second channel of the second section; (v) rotating at least one of the first section or the second section about the level indicator; and (vi) continuing rotation until the top surface of the first section is flush with the top surface of the second section.

In some aspects, the method may further comprise, subsequent to rotating at least one of the first section or the second section, engaging a first flange of the first section with the second inner surface.

In some aspects, the method may further comprise, concurrently with engaging the first flange with the second inner surface, engaging a second flange of the second section the first inner surface.

In another aspect, a method of estimating a slope is disclosed. The method comprises: (i) stepping with both feet onto a top surface of an apparatus body, the top surface comprising a concave surface and slope markings, the slope markings having a range of values, the feet being spaced approximately shoulder-width apart; (ii) estimating a percentage slope of the top surface to establish an estimated slope; (iii) observing a value of the slope markings positioned equidistant between both feet, the value being an actual slope; and (iv) comparing the estimated slope with the actual slope.

Generally, the slope estimator can be made of any material known to one having skill in the art and can include materials such as plastic, wood, and/or metal. Each of the components of the training apparatus described herein may be manufactured and/or assembled in accordance with the conventional knowledge and level of a person having skill in the art.

While various details, features, combinations are described in the illustrated embodiments, one having skill in the art will appreciate a myriad of possible alternative combinations and arrangements of the features disclosed herein. As such, the descriptions are intended to be enabling only, and non-limiting. Instead, the spirit and scope of the invention is set forth in the appended claims.

First Illustrated Embodiment

Now turning to the drawings, FIG. 1-3B show a slope estimator training apparatus (100) in accordance with a first illustrated embodiment. The slope estimator training apparatus comprises an apparatus body (110) having a top surface (120), a bottom surface (122) opposite the top surface, and an apparatus periphery (111). The apparatus periphery comprises a first minor side (112), a second minor side (113) opposite the first minor side, a first major side (114), and a second major side (115) opposite the first major side. The top surface comprises a concave surface (121) having a trough (128) at a center segment (125) wherein the center segment extends from the first major side to the second major side. The center segment partitions the apparatus body into a first section (130) and a second section (140) such that each of the first and second sections comprise a sloped surface (127) inclining downward toward the center segment. The bottom surface comprises a level surface (124) and a plurality of pockets (123) having a lattice structure. The first section and second section may be characterized as a first half (131) and a second half (141), respectively, of the apparatus body wherein the center segment forms a midpoint of the apparatus body. The first and second sections may be inseparable or detachably coupled to each other.

Disposed on the top surface (120) are slope markings (160) to provide feedback to a player when the player is estimating a slope on the slope estimator training apparatus (100). The slope markings comprise a first set (161) and a second set (162) in mirror configuration with each other in order for the apparatus to be easily readable in either direction. The first set of slope markings is adjacent to the first major side (114) and the second set of slope markings is adjacent to the second major side (115). The first set comprises a range of values having both a descending sequence (163) and an ascending sequence (164). The descending sequence is disposed on the first section (130) and the ascending section is disposed on the second section (140). The range of values in the first set includes a value of zero (165) wherein the descending sequence and the ascending sequence share the value of zero. The ascending sequence of the first set can be characterized as being in a mirror configuration with the descending sequence of the first set. The second set of slope markings follows a similar configuration of having a respective ascending sequence and a respective descending sequence.

The slope estimator training apparatus (100) further comprises a level indicator (150) disposed within an interior portion (126) of the apparatus body (110) between the top surface (120) and the bottom surface (122). A viewing port (152) is disposed between the level indicator and the top surface in order for the level indicator to be externally viewable. The level indicator is disposed at the center segment (125) and is coupled to both the first section (130) and the second section (140). The level indicator comprises a tubular form (151) such that the tubular form is perpendicular to the center segment. The level indicator may be removable or fixed within the apparatus body. In embodiments where the level indicator is removable, a level indictor holder (153) can be utilized to secure the level indicator at with one of the plurality of pockets (123) at the bottom surface.

Second Illustrated Embodiment

Figure 4:
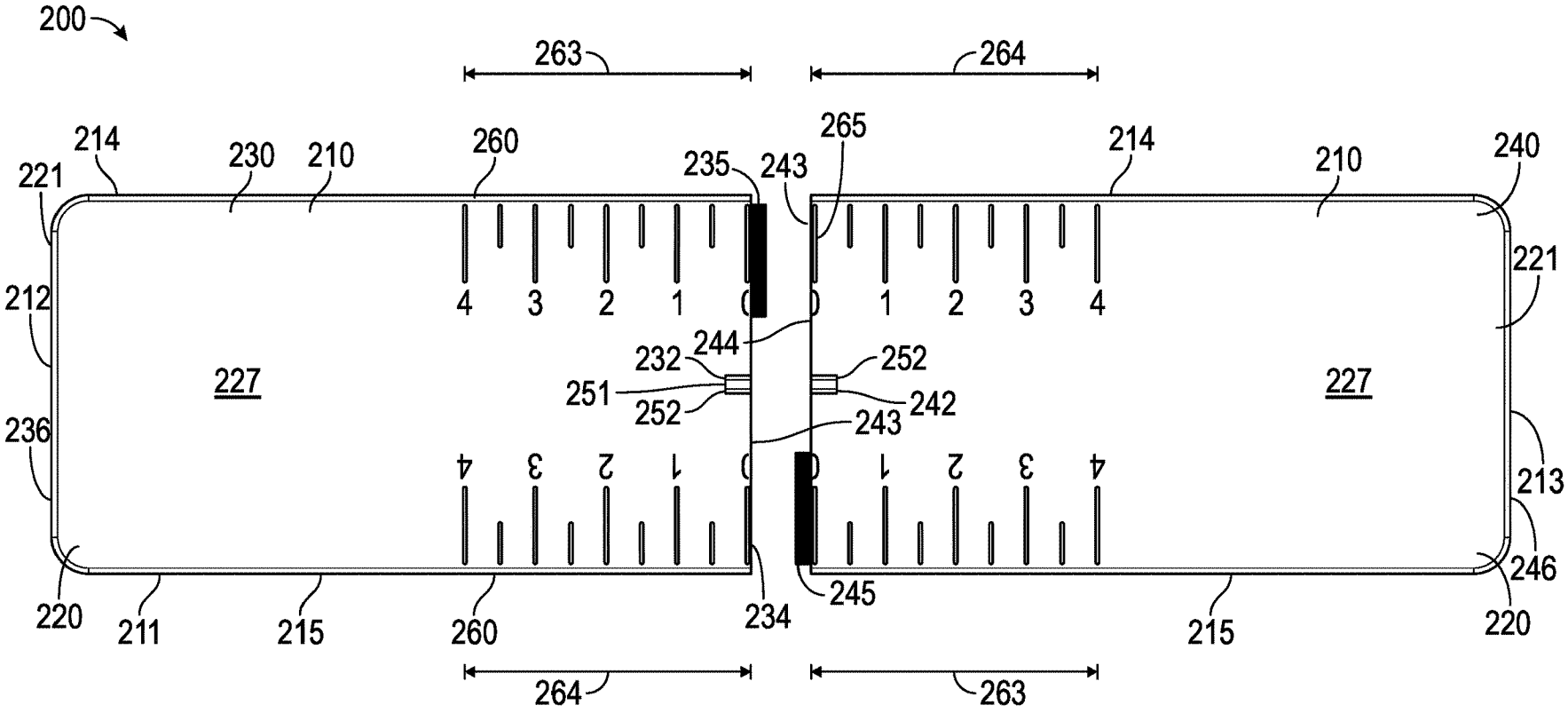
FIG. 4 shows a top view of the slope estimator training apparatus in accordance with a second illustrated embodiment.
Figure 5A:
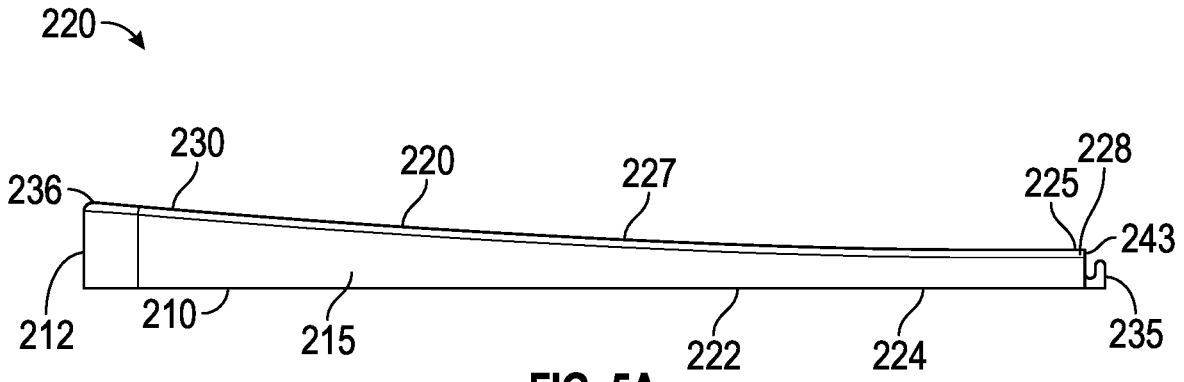
FIG. 5A shows a side view of the slope estimator training apparatus according to the second illustrated embodiment.
Figure 5B:
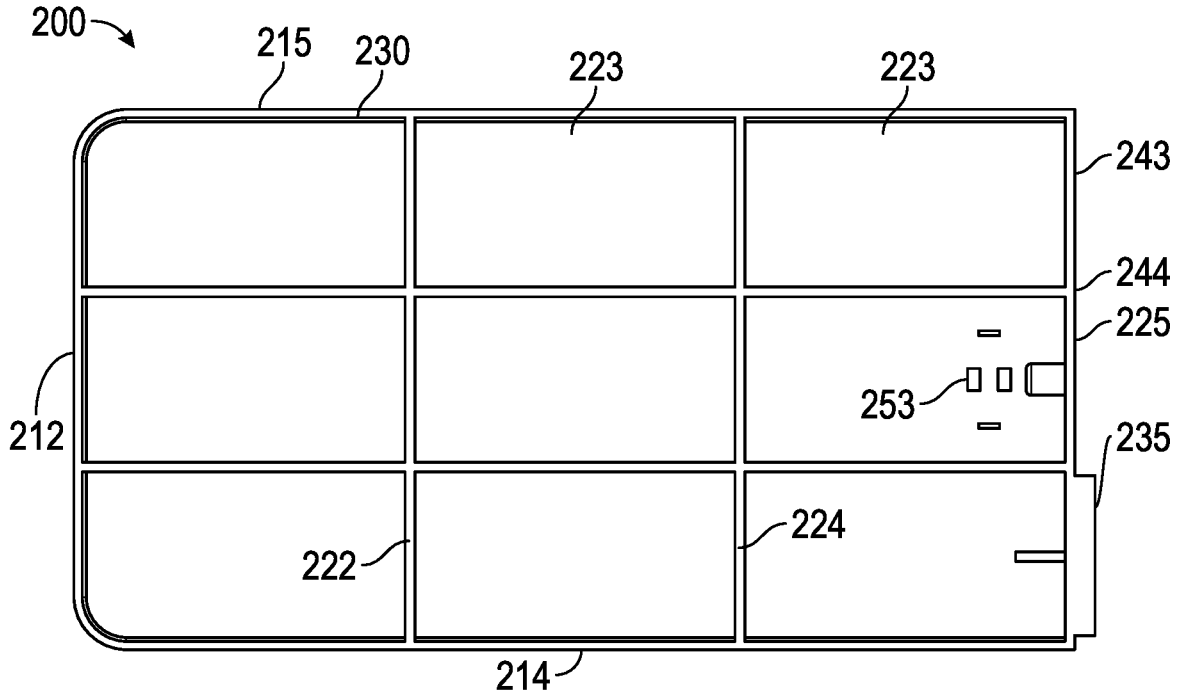
FIG. 5B shows a bottom view of the slope estimator training apparatus according to the second illustrated embodiment.

FIG. 4-5B show a slope estimator training apparatus (200) in accordance with the second illustrated embodiment. The slope estimator comprises a first section (230) configured to detachably couple to a second section (240). When detachably coupled, the first and the second sections forms an apparatus body (210) having an apparatus periphery (211). The apparatus periphery comprises a first minor side (212), a second minor side (213) opposite the first minor side, a first major side (214), and a second major side (215) opposite the first major side. The apparatus body further comprises a top surface (220) and a bottom surface (222) opposite the top surface. Each of the first section and second section comprises a sloped surface (227) such that, when coupled together, the apparatus body forms a concave surface (221). In some embodiments, the first section is identical to the second section.

The first section (230) comprises a first broad side (236) disposed at the first minor (212) side, and a first narrowed side (243) disposed opposite the first broad side. The first narrowed side comprises a first inner surface (234), the first inner surface being disposed between the top surface (220) and the bottom surface (222) of the first section. A first flange (235) is coupled to the first inner surface. Similarly, the second section (240) comprises a second broad side (246) disposed at the second minor side (213), and a second narrowed side (243) disposed opposite the second broad side. The second narrowed side comprises a second inner surface (244), the second inner surface being disposed between the top surface and the bottom surface of the second section. A second flange (245) is coupled to the second inner surface. The first flange is configured to engage with the second inner surface, and the second flange is configured to engage with the first inner surface. When the first section is coupled to the second section, the first narrowed side abuts the second narrowed side and forms a center segment (225) of the apparatus body wherein the center segment is a trough (228) of the concave surface (221).

Each of the first section (230) and the second section (240) comprises slope markings (260). The slope markings are disposed on the top surface (220) and comprise a range of values. The range of values includes a descending sequence (263) and an ascending sequence (264). The first section and the second section each comprise the descending sequence and the ascending sequence. The ascending sequence and the descending sequence on the first section are characterized as being in a mirror configuration. Likewise, the ascending sequence and the descending sequence of the second section are characterized as being in a mirror configuration. Each of the descending and ascending sequences comprises a value of zero (265) wherein the value of zero of the descending sequence of the first section is shared with the ascending sequence of the second section. Additionally, the value of zero of the descending sequence of the second section is shared with the ascending sequence of the first section.

The first section (230) comprises a first channel (232) disposed at a midpoint of the first inner surface (234). The first channel is configured to receive a portion of a level indicator (250). Correspondingly, the second section (240) comprises a second channel (242) disposed at a midpoint of the second inner surface (244). The second channel is configured to receive an alternate portion of the level indicator. The level indicator is configured to couple to each of the first section and the second section at the center segment (225). The level indicator may comprise a tubular form (251) wherein the tubular form is perpendicular to the center segment. Each of the first and second sections comprises half of a viewing port (252), the viewing port being disposed between the first/second channels and the top surface.

The bottom surface (222) comprises a level surface (224) and a plurality of pockets (223) in a lattice formation. A level indicator holder (253) is disposed within one of the plurality of pockets of each of the first section (230) and the second section (240) for securing the level indicator when the slope estimator training apparatus (200) is in a collapsed arrangement.

A method of assembling the slope estimator training apparatus (200) may include (i) inserting the level indicator (250) into the first channel (232); (ii) aligning the second channel (242) with the first channel; (iii) misaligning the top surface (220) of the second section (240) with the top surface of the first section (230); (iv) inserting a remaining portion of the level indicator into the second channel; (v) rotating at least one of the first section or the second section about the level indicator; (vi) engaging the first flange (235) of the first section with the second inner surface (244); (vi) engaging the second flange (245) of the second section the first inner surface (324); and (vii) continuing rotation until the first flange and the second flange are fully engaged with the second inner surface and the first inner surface, respectively, and the top surface of the first section is flush with the top surface of the second section.

Figure 6A:
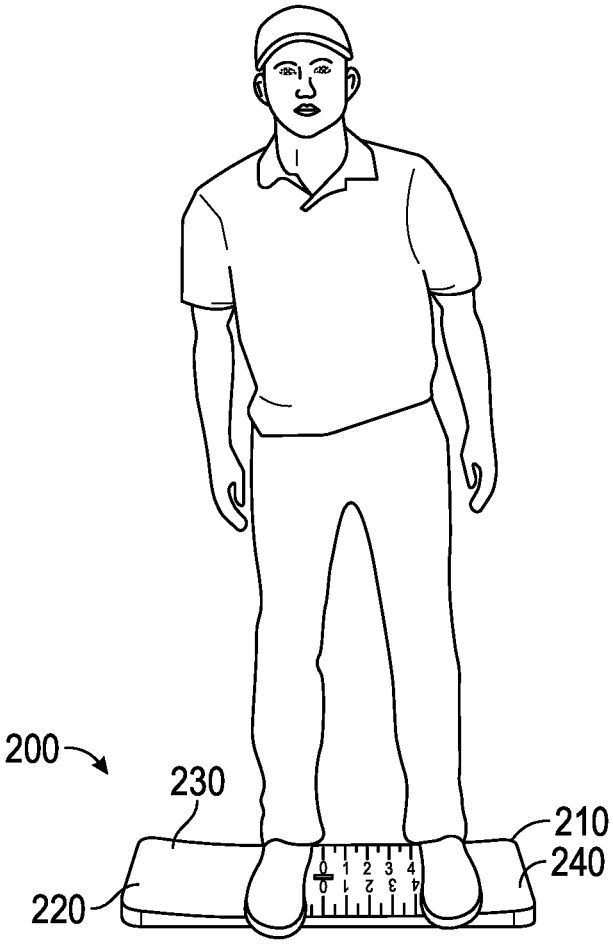
FIG. 6A shows a front view of a player utilizing the slope estimator training apparatus.
Figure 6B:
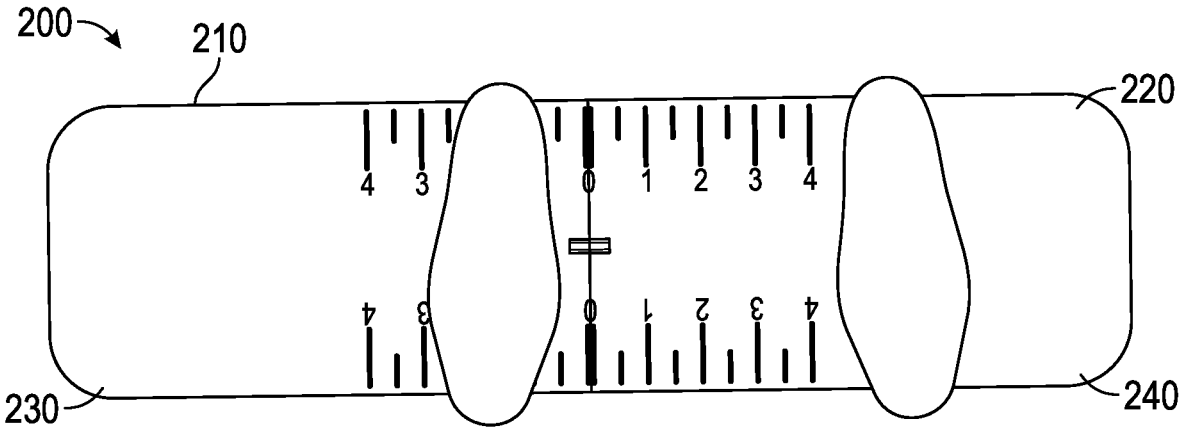
FIG. 6B shows a top view of the slope estimator training apparatus in use by the player.

FIG. 6A-6B show the slope estimator training apparatus (200) utilized by a player in accordance with either the first or second illustrated embodiments. The player steps onto the top surface (220) of the apparatus body (210) with both feet space approximately shoulder-width apart. Without looking, the player will estimate the percentage slope based only on feel. After an estimated slope has been made the by the player, the player will then look down between their feet and observe what value of the slope markings is center to their feet. That value is the actual slope. The actual slope is compared with the estimated slope to assess accuracy. The player can then repeat the process to improve their slope estimating ability which will result in an improved putting performance. For example, if the player's feet are on the 3 and 1, the actual slope percentage will be two. One having skill in the art will appreciate that a player's feet can be on one or both of a first section (230) and a second section (240) of the apparatus body.

Third Illustrated Embodiment

Figure 7:
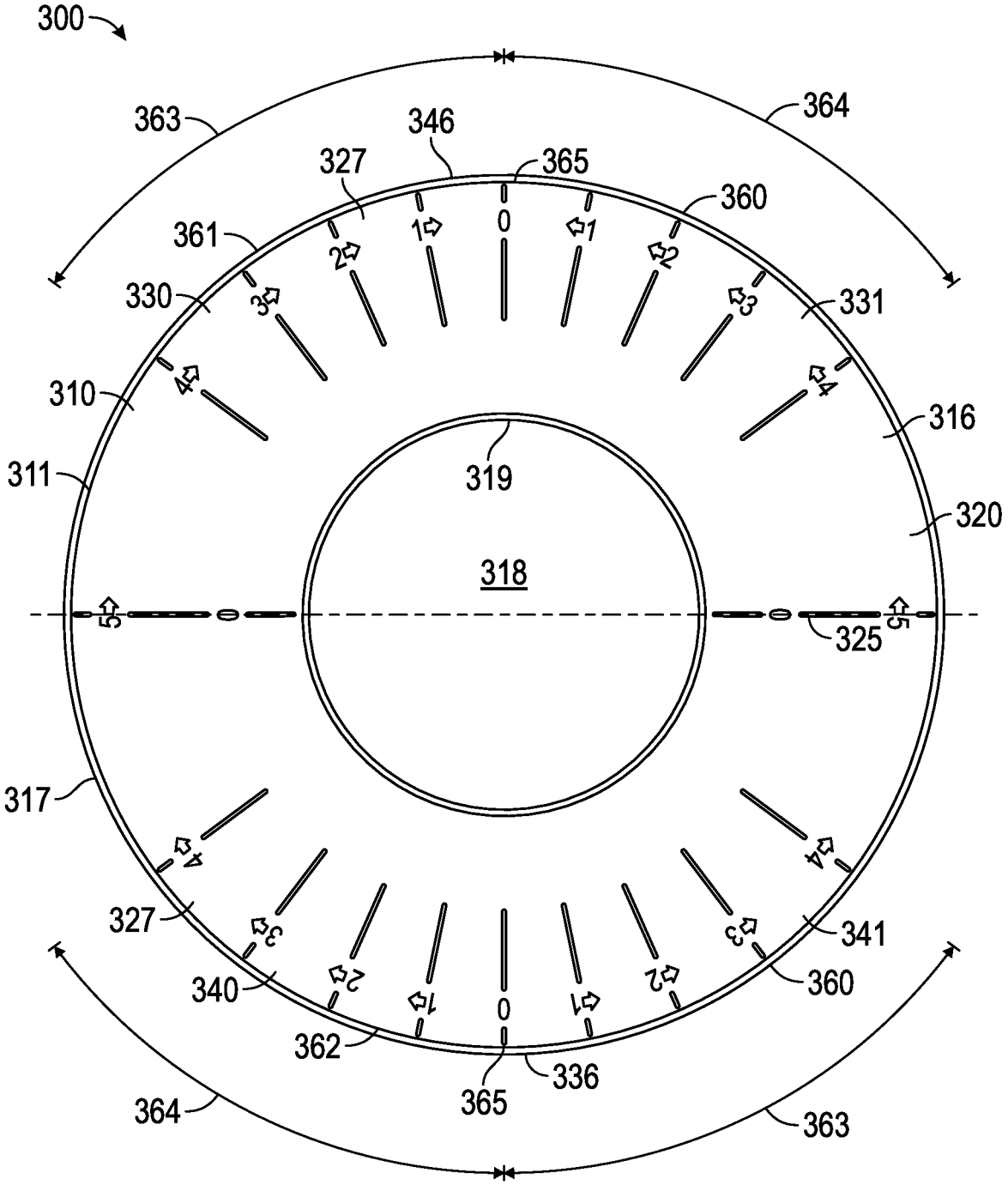
FIG. 7 shows a top view of the slope estimator training apparatus in accordance with a third illustrated embodiment.
Figure 8B:
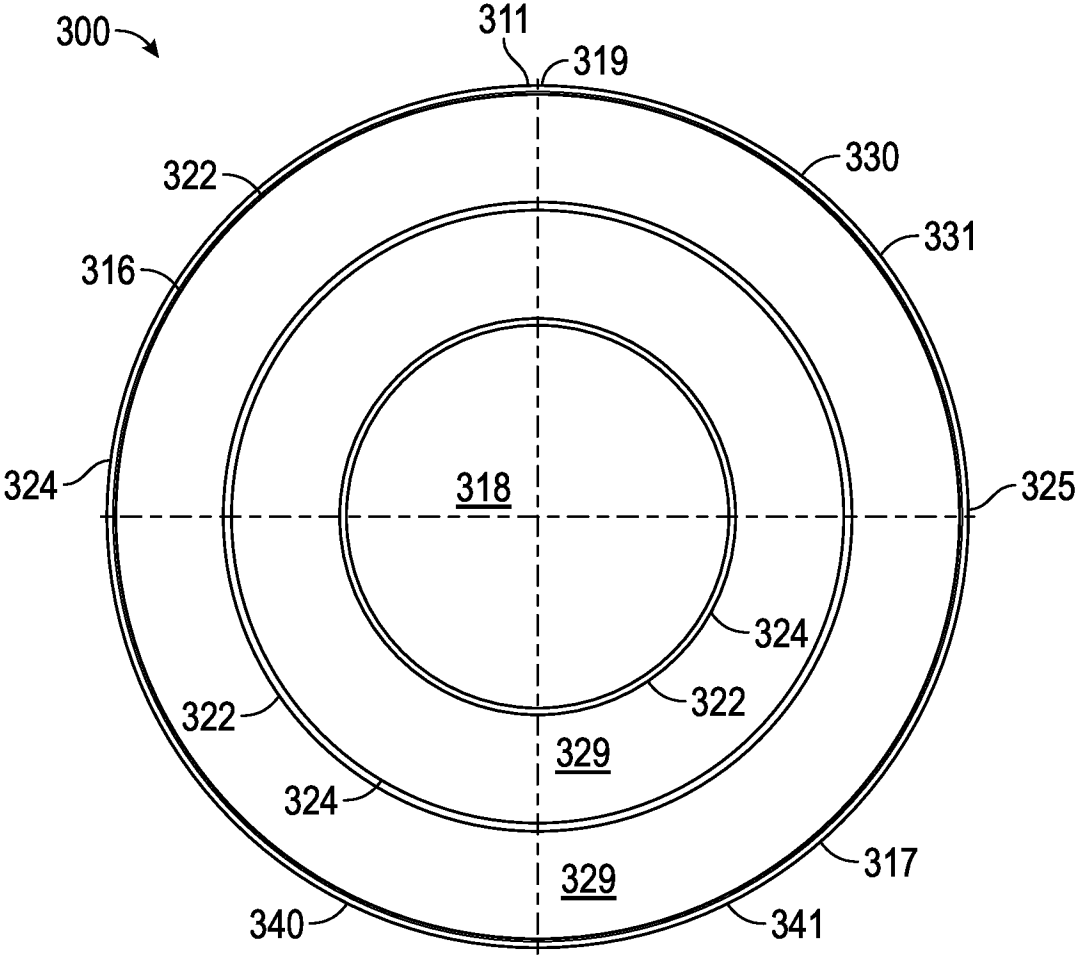
FIG. 8B shows a bottom view of the slope estimator training apparatus according to the third illustrated embodiment.
Figure 8A:
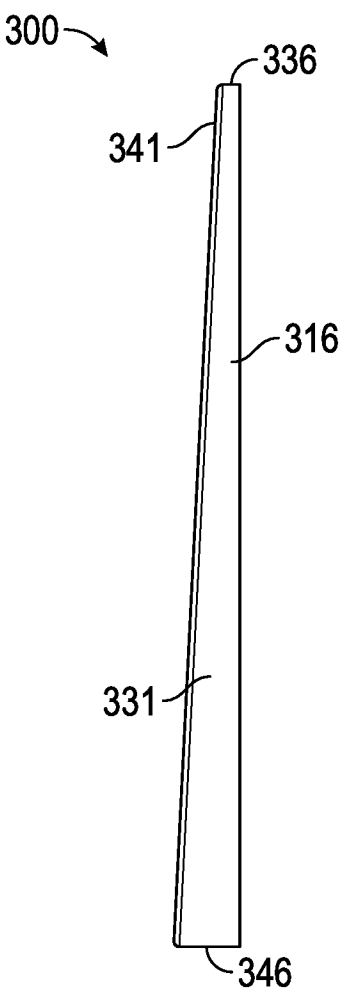
FIG. 8A shows a side view of the slope estimator training apparatus according to the third illustrated embodiment.

FIG. 7-8B show a slope estimator training apparatus (300) in accordance with the third illustrated embodiment. The slope estimator training apparatus comprises an apparatus body (310) being an annular body (316), the annular body having a top surface (320) and a bottom surface (322) opposite the top surface, and a central opening (318) extending through both the top and bottom surfaces. The apparatus body further comprises an apparatus periphery (311) being a circular periphery (317). A center segment (325) divides, or partitions, the apparatus body into a first section (330) and a second section (340) which can be characterized as a first half (331) and a second half (341), respectively. The top surface comprises a sloped surface (327) declining downward from the first half through the second half. The first half comprises a broadest edge (346) of the apparatus periphery and the second half comprises a narrowest edge (336) of the apparatus periphery. The bottom surface comprises a level surface (321). The bottom surface further comprises a plurality of pockets (323) being in an annular formation in order to decrease weight of the (300) slope estimator training apparatus.

The top surface (320) further comprises slope markings (360) comprising a first set (361) of slope markings and a second set (362) of slope markings. The first set is disposed on the first half (331) and the second set is disposed on the second half (341). Each of the first and second sets each comprise a descending sequence (363) and an ascending sequence (364). The first set can be characterized as being in a mirror configuration with the second set. Furthermore, the descending sequence in the first set is characterized as being in a mirror configuration with the ascending sequence in the first set. Likewise, the descending sequence in the second set is characterized as being in a mirror configuration with the ascending sequence in the second set. The ascending and descending sequence of each of the first and second sets is divided by a middle segment (319) on both the first half and the second half. The first set and second set each comprise a value of zero (365) amongst their plurality of values wherein the value of zero is shared by the ascending sequence and descending sequence of the respective set.

| Feature List | |
|---|---|
| slope estimator training apparatus | (100; 200; 300) |
| apparatus body | (110; 210; 310) |
| apparatus periphery | (111; 211; 311) |
| first minor side | (112; 212) |
| second minor side | (113; 213) |
| first major side | (114; 214) |
| second major side | (115; 215) |
| top surface | (120; 220; 320) |
| concave surface | (121; 221) |
| bottom surface | (122; 222; 322) |
| plurality of pockets | (123; 223; 323) |
| level surface | (124; 224; 324) |
| center segment | (125; 225; 325) |
| interior portion | (126) |
| sloped surface | (127; 227; 327) |
| trough | (128; 228) |
| first section | (130; 230; 330) |
| first half | (131; 231; 331) |
| second section | (140; 240; 340) |
| second half | (141; 241; 341) |
| level indicator | (150; 250) |
| tubular form | (151; 251) |
| viewing port | (152; 252) |
| level indicator holder | (153; 253) |
| slope markings | (160; 260; 360) |
| first set | (161; 261; 361) |
| second set | (162; 262; 362) |
| descending sequence | (163; 263; 363) |
| ascending sequence | (164; 264; 364) |
| value of zero | (165; 265; 365) |
| first channel | (232) |

-continued

| Feature List | |
|---|---|
| first narrowed side | (233) |
| first inner surface | (234) |
| first flange | (235) |
| first broad side | (236) |
| second channel | (242) |
| second narrowed side | (243) |
| second inner surface | (244) |
| second flange | (245) |
| second broad side | (246) |
| annular body | (316) |
| circular periphery | (317) |
| central opening | (318) |
| middle segment | (319) |
| narrowest edge | (336) |
| broadest edge | (346) |

What is claimed is:

1. A slope estimator training apparatus, comprising:

an apparatus body having an apparatus periphery, the apparatus periphery comprising a first minor side, a second minor side opposite the first minor side, a first major side adjacent to each of the first and second minor sides, and a second major side opposite the first major side;

a top surface and a bottom surface opposite the top surface, the top surface comprising a concave surface;

a center segment extending from the first major side to the second major side, the center segment partitions the apparatus body into a first section and a second section, the center segment comprising a trough of the concave surface; and slope markings disposed on the top surface at each of the first section and the second section, the slope markings comprising a range of values having both a descending sequence and an ascending sequence, wherein the descending sequence is disposed on the first section and the ascending sequence is disposed on the second section, wherein the slope markings comprise a measurement of steepness of the concave surface.

2. The apparatus of claim 1, further comprising a level indicator disposed at the center segment and coupled to each of the first section and the second section, the level indicator being disposed between the top surface and the bottom surface.

3. The apparatus of claim 2, the level indicator further comprising a tubular form wherein the tubular form is perpendicular to the center segment.

4. The apparatus of claim 2, further comprising a viewing port disposed between the level indicator and the top surface, the viewing port configured to make the level indicator externally viewable.

5. The apparatus of claim 1, the slope markings further comprising a first set of slope markings and a second set of slope markings.

6. The apparatus of claim 5, wherein the first set and the second set each comprise the descending sequence and the ascending sequence.

7. The apparatus of claim 1, wherein the ascending sequence is in a mirror configuration with the descending sequence.

8. The apparatus of claim 1, wherein the range of values comprises a value of zero, the value of zero disposed at the center segment.

9. The apparatus of claim 8, wherein the ascending sequence and the descending sequence share the value of zero.

10. The apparatus of claim 1, wherein the first section and the second section are detachably coupled, such that the first section is configured to fully separate from the second section.

11. The apparatus of claim 10, the first section further comprising a first narrowed side opposite the first minor side, and the second section further comprising a second narrowed side opposite the second minor side, wherein the first narrowed side and the second narrowed side form the center segment, the first narrowed side further comprising a first inner surface, and the second narrowed side further comprising a second inner surface, wherein the first inner surface further comprises a first flange, and the second inner surface further comprises a second flange, the first flange being configured to engage with the second inner surface, and the second flange being configured to engage with the first inner surface.

12. A slope estimator training apparatus, comprising:

an apparatus body having a top surface and bottom surface opposite the top surface, the top surface comprising a sloped surface;

a center segment extending across an apparatus periphery of the apparatus body, the center segment partitioning the apparatus body into a first section and a second section, each of the first and second section comprising the sloped surface; and slope markings disposed on the top surface at each of the first section and the second section, the slope markings comprising a range of values having both a descending sequence and an ascending sequence, the descending sequence disposed on the first section and the ascending sequence disposed on the second section, wherein the slope markings comprise a measurement of steepness of the sloped surface.

13. The apparatus of claim 12, the slope markings further comprising a first set of slope markings and a second set of slope markings.

14. The apparatus of claim 13, wherein the second set is in a mirror configuration with the first set.

15. The apparatus of claim 13, wherein the first set and the second set each comprise the descending sequence and the ascending sequence.

16. The apparatus of claim 12, wherein the ascending sequence is in a mirror configuration with the descending sequence.

17. A detachable section of a slope estimator training apparatus, the detachable section comprising:

an apparatus body having an apparatus periphery comprising a broad side, a narrowed side opposite the broad side, a first major side, and a second major side opposite the first major side;

a top surface and a bottom surface opposite the top surface, the top surface comprising a sloped surface tapering downwards from the broad side toward the narrowed side;

an inner surface disposed at the narrowed side, the inner surface comprising a flange coupled thereto; and slope markings disposed on the top surface, the slope markings comprising a range of values having at least one of a descending sequence or an ascending sequence, wherein the slope markings comprise a measurement of steepness of the sloped surface.

18. The detachable section of claim 17, further comprising a channel extending into the inner surface, the channel configured to receive a portion of a level indicator.

19. The detachable section of claim 18, further comprising a viewing port disposed between the channel and the top surface.

20. The detachable section of claim 17, wherein the detachable section is configured to detachably couple to a secondary detachable section such that the detachable section is fully separate from the secondary detachable section.

* * * * *